United States Patent [19]

Reid

[11] Patent Number: 4,867,188

[45] Date of Patent: Sep. 19, 1989

[54] ORTHOPAEDIC TROLLEY

[76] Inventor: Michael Reid, Latchmoor, 15 Argyle Road, Mudeford, Christchurch, Dorset, BH23 3NW, Great Britain

[21] Appl. No.: 7,557

[22] Filed: Jan. 28, 1987

[30] Foreign Application Priority Data

Jan. 28, 1986 [GB] United Kingdom ..... 8602025
Jun. 23, 1986 [GB] United Kingdom ..... 8615267

[51] Int. Cl.[4] ..... A61H 3/00

[52] U.S. Cl. ..... 135/67; 272/70.4; 297/423

[58] Field of Search ..... 135/67, 68, 69, 72, 135/73, 84; 272/70.1, 70.2, 70.3, 70.4; 297/5, 6, 423; 128/68, 166, 80 G, ; 248/188.7; 280/87.02 W, 32.6, 87.04 R

[56] References Cited

U.S. PATENT DOCUMENTS

| | | | |
|---|---|---|---|
| 2,318,059 | 5/1943 | Cooper | 280/32.6 |
| 2,448,427 | 8/1948 | Gordon | 280/32.5 |
| 2,530,544 | 11/1950 | Schwantes | 280/87.02 W |
| 2,652,097 | 9/1953 | Warren | 155/22 |
| 2,778,370 | 1/1957 | Chamblee | 135/68 |
| 3,044,797 | 7/1962 | Borland | 280/32.6 |
| 3,432,162 | 3/1969 | Flemming | 297/5 |
| 3,532,356 | 10/1970 | Lillibridge | 280/87.02 W |
| 3,709,515 | 1/1973 | Kilcullen | 280/87.02 W |
| 4,188,966 | 2/1980 | Palmer et al. | 297/5 |
| 4,254,948 | 3/1981 | Jacobs | 272/70.3 |
| 4,291,715 | 9/1981 | Monte | 135/68 |
| 4,342,466 | 8/1982 | Morgan | 280/87.04 R |
| 4,557,257 | 12/1985 | Fernandez et al. | 128/80 G |
| 4,621,804 | 11/1986 | Mueller | 280/87.02 W |
| 4,623,158 | 11/1986 | Monreal | 280/618 |

*Primary Examiner*—Richard J. Johnson
*Assistant Examiner*—Charles H. Sam
*Attorney, Agent, or Firm*—Kuhn and Muller

[57] ABSTRACT

An orthopaedic trolley for leg support to allow mobility in cases of injury or disablement of the foot or ankle comprising a support structure 18 slidably mounted in a sleeve 26 having legs 20 splayed outwardly therefrom. The legs 20 are mounted on castors 24 or rotatable wheels. A cradle 14 is provided having a foam filled 16 inner portion and extending therefrom a maneuvering handle 22.

8 Claims, 2 Drawing Sheets

ORTHOPAEDIC TROLLEY

FIELD OF THE INVENTION

The present invention relates to an orthopaedic trolley or scooter and in particular to a trolley for leg support which can allow mobility in cases of injury or disablement of the foot or ankle. The trolley is particularly useful when no weight is to be applied to the lower leg and in particular to the injured foot or ankle, and can be used for amputees.

BACKGROUND OF THE INVENTION

Various devices are known for supporting injured or paraplegic persons. For example U.S. Pat. No. 4,111,445 describes a frame means having standing or kneeling platform mounted on a trolley type device. U.S. Pat. No. 3,596,668 describes an ambulatory device having a removable bracket with a padded knee or leg support mounted on an open frame structure. U.S. Pat. No. 4,469,372 describes a tripodal, rollable stool. U.S. Pat. No. 4,921,715 discloses a lower leg or foot support crutch. U.S. Pat. No. 4,254,948 describes a complicated crutch arrangement having a drive means operable by hand. U.S. Pat. No. 4,18,869 describes an orthopaedic walker having a seat. U.S. Pat. No. 4,111,445 shows a platform having castors with a body restraining means.

The prior art described above discloses rather complex arrangements which are generally difficult to use by a newly injured patient.

SUMMARY OF THE INVENTION

The present invention is directed to an orthopaedic trolley comprising a support structure having leg means, the support structure having mounted thereon a patient knee or leg support means, the leg means extending outwardly from the patient knee or leg support means, the leg means being mounted on rotatable wheels.

In a preferred embodiment of the knee support means is adjustably mounted on the support structure such that the height of the knee support means may be adjusted upwardly or downwardly to accommodate different sizes of user.

DRAWINGS

The present invention will be further described by way of example only, with reference to the accompanying drawings in which.

DETAILED DESCRIPTION OF THE PREFERRED EMBODIMENT

Figure 1:
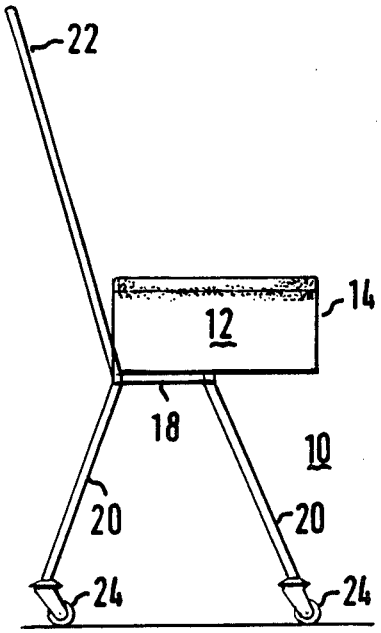
FIG. 1 shows a side view of the orthopaedic trolley.
Figure 2:
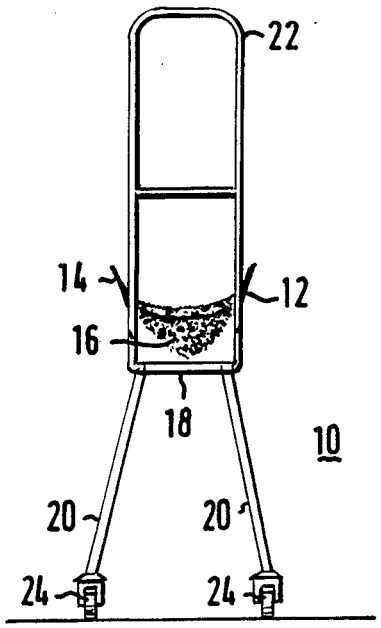
FIG. 2 shows an end view of the othopaedic trolley.
Figure 4:
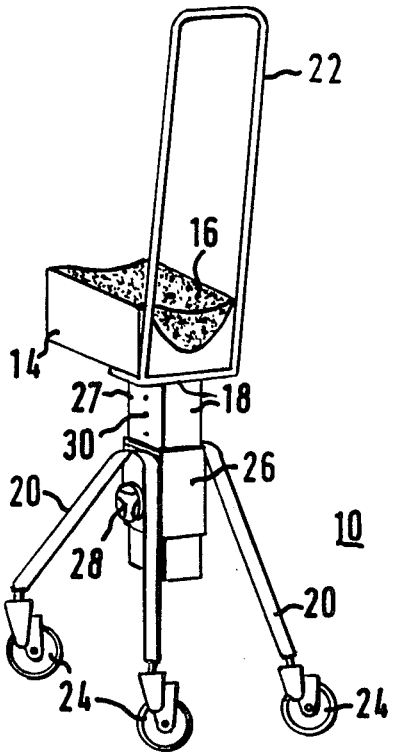
FIG. 4 is a perspective view of a further embodiment of the present invention which has an adjustable knee support.
Figure 5:
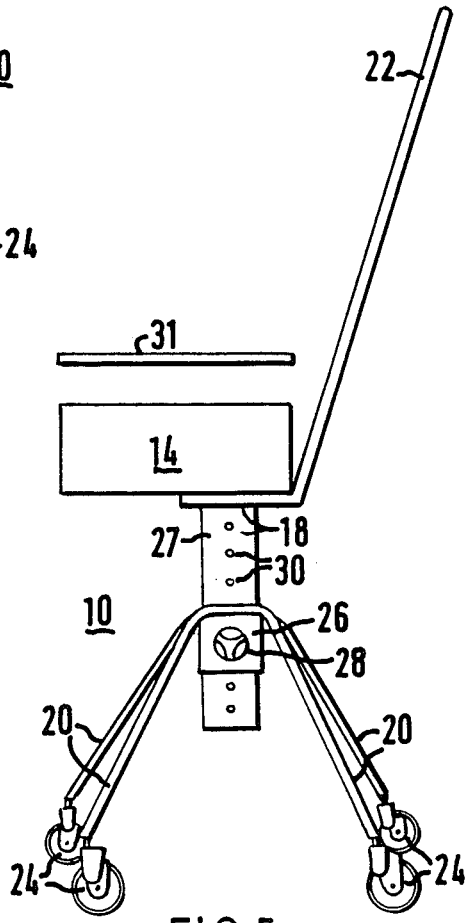
FIG. 5 is a side view of the embodiment shown in FIG. 4.

Referring now to FIGS. 1 and 2, an orthopaedic trolley generally designated 10 has a knee support means 12 which comprises a cradle 14 which is preferably foam filled 16. The cradle 14 has longitudinally extending sides and open ends. The knee support means is generally mounted on a support structure 18 having four legs 20 extending therefrom. The support structure can be a rectangular frame which lays horizontally and which has legs 20 extending from the corners. Alternative support structures are shown in FIGS. 4 and 5. The rectangular frame 18 is generally attached to the cradle 14 towards one end to ensure proper balance, as will be further explained below. Preferably extending uprightly from the same end as the rectangular frame 18 is a manoeuvring handle 22.

The four legs 20 are generally splayed outwardly as they extend downwardly from the support structure such that the area encompassed by the base of the legs is greater than the area of the support cradle. This provides enhanced stability for the trolley 10. Although four legs are described any number of leg can be used as long as the legs in combination provide the enhanced stability.At the base of each of the legs are mounted rotatable wheels 24, preferably in the form of castors. The castors also preferably have a vertical bearing on the leg mounted where the castor is attached to the leg 20 and a horizontal bearing from which the wheel of the castor rotates. The castor preferably has a pliable tyre e.g. a rubber tyre and is of such size that when the wheels are rotated on flat ground or slightly uneven surfaces such as grass or gravel, no heavy resistance is encountered.

Turning now to FIGS. 4 and 5, a further embodiment is described which shows an orthopaedic trolley 10 which is adjustable. As in FIGS. 1 and 2 like numerals are applied to like parts.

Therefore the cradle 14 which is foam filled 16 has a support structure 18 having extending therefrom legs 20. A manoeuvring handle 22 extends upwardly and outwardly from the cradle 14. This embodiment differs from the embodiment of FIGS. 1 and 2 in that the support structure 18 is generally adjustable. The support structure 18 comprises a box section sleeve 26 which receives mounting means 27 within the sleeve. The sleeve 26 is generally rectangular although it may be square or even tubular with the corresponding mounting means 27 forming a slidable fit within the sleeve 26. A pin 28 having a handle extends through the sleeve 26 and through holes 30 in mounting means 18. As in FIGS. 1 and 2 the legs 20 splay outwardly from the cradle 14 to provide stable support. The legs extending to castors 24. Alternative embodiments are envisaged whereby the mounting means 27 can extend downwardly to form an upright support for the cradle 14 and the legs extend horizontally from the base of the support means 27. The legs 20 in this form would extend outwardly to provide sufficient support base for the cradle 14. The disadvantage of this embodiment is that the horizontal mounting of the legs can cause obstruction whereas the splayed legs allow small obstructions to pass between the legs 20.

In order for the cradle 14 to be adjustable in height the pin 28 is removed, the support means is moved upwardly or downwardly as required by the patient and the pin 28 is replaced to pass through an aligned hole 30 to lock the support means 27 in the required position. A sliding lid 31 can be positioned on the cradle 14 to convert the trolley into a mobile seat for the user.

In general, the length of the cradle 14 is about twice the width of the cradle 14. The wheelbase of the trolley may generally be about twice the dimensions of the track although these dimensions may vary from 1.5 to 3 in proportion of length to width of the cradle 14 and in proportion of wheelbase to track of the trolley in order to provide a stable base for the trolley.

The trolley may be manufactured in demountable parts, particularly the version illustrated in FIGS. 4 and 5. In the case of FIG. 4, the manoeuvring handle 22, the cradle 14 the support structure 18 and legs 20 may be separate parts.

Figure 3:
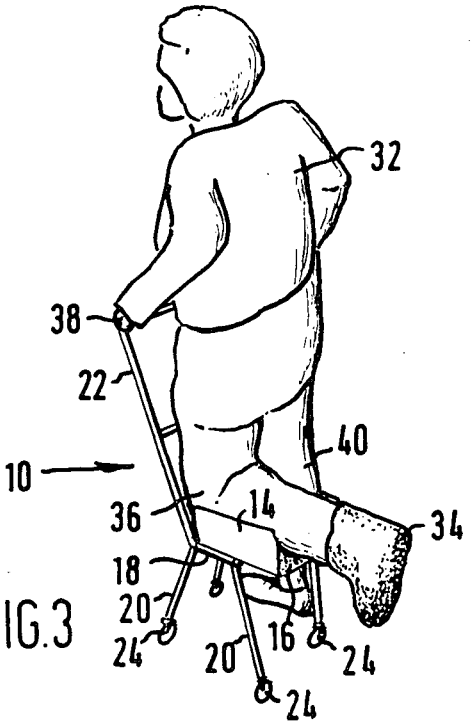
FIG. 3 shows a perspective view of the trolley of FIGS. 1 and 2 in use.

FIG. 3 shows an orthopaedic trolley 10 in use by a patient. This use is equally applicable to the embodiment shown in FIGS. 1 and 2 as well as FIGS. 4 and 5 except the adjustability of FIG. 5 is not available on the embodiment shown in FIG. 3. A patient 32 having, for example, a foot in a plaster cast 34 places his knee 36 in the cradle 14 on the foam 16. As can be seen on FIG. 3 the weight of the knee and the upper part of the body extend towards one end of the cradle 14 and for this reason the cradle 14 is mounted such that the support structure 18 falls immediately below this weight bearing area of the knee. The splayed legs 20 clearly provide lateral support as well as forward and backward stability for the orthopaedic trolley. The patient 32 places his hands 38 on the manoeuvring handle 22 to provide steerage for the orthopaedic trolley 10. In use the trolley 10 is scooted by the patient using his able limb 40. It should be understood that the trolley is equally useful for both injured left or right limbs providing the remaining limb is sufficient to support the weight of the body.

Thus the patient simply kneels the injured leg 36 into the foam rubber filled cradle 14 so that the shin is horizontal and the foot or ankle within a plaster cast 34, for example, are comfortably supported out of harms way.

It is possible for the patient to move around easily, steering the trolley with the knee or if preferred with a hand on the manoeuvring handle 22. The orthopaedic trolley 10 can easily be manoeuvred over door thresholds or ridges by lifting the front pair of wheels 24 over the obstruction while still supporting the weight of the limb 36. The back wheels 24 follow in the same way. The manoeuvring handle 22 is used for lifting the trolley by supporting the weight on the able limb 40 to ensure that obstructions can be overcome. The orthopaedic trolley 10 can be used on most reasonably flat surfaces including moderate inclines. It can also be used on slightly uneven surfaces such as grass or gravel because the manoeuvring handle 22 can be used to lift or pull the orthopaedic trolley 10 forward with each stride.

Because of the rotatable wheels 24, preferably in the form of castors, the orthopaedic trolley 10 can be turned in its own length. It has been found with practice that the trolley becomes a reasonably efficient substitute for the lower leg.

The trolley was designed for patients with injured feet or ankles to enable them to support the injured parts while convalescing. However it can also be used by patients with long term foot or ankle problems.

It is believed that one of the advantages of the present invention is that the patient is much more mobile than with crutches or a wheelchair. Both hands are free for opening doors or carrying things whilst using the orthopaedic trolley 10. The rate of progress of the patient can be quicker than with crutches, travel is safer and much more comfortable. In addition the orthopaedic trolley 10 is only a small fraction of the weight and size of a wheelchair and is much easier to operate particularly in small spaces, through doors and the like.

In addition the trolley has distinct advantages over crutches because the weight of the body is applied to the able limb as well as to the injured or disabled limb, rather than under the arms which are not used to carrying such weight.

Other uses of the trolley allow it to be sat upon by the injured person where required.

What is claimed is:

1. An orthopaedic trolley comprising a support structure which comprises a plurality of depending legs, each of said legs having a rotatable wheel of the castor type mounted at its outer end, the support structure having mounted thereon a patient knee and leg support means, said knee and leg support means comprising a principal weight bearing area for supporting the knee and a secondary weight bearing area for supporting the leg, said principal weight bearing area being located substantially directly above the center point of the area encompassed between said depending legs, the legs being splayed outwardly from a common mounting member beneath a predetermined portion of said knee and leg support means, said predetermined portion consisting essentially only of said principal weight bearing area so as to provide a stable base for the knee and leg support means said secondary weight bearing area extending rearwardly of said predetermined portion.

2. An orthopaedic trolley as claimed in claim 1 wherein the orthopaedic trolley has a maneuvering handle extending upwardly and outwardly from the patient knee and leg support means.

3. The orthopaedic trolley of claim 1 in which said mounting member comprises means for adjustably mounting said knee and leg support means on said support structure such that the height of said knee and leg support means may be adjusted upwardly or downwardly to accomodate different sizes of user.

4. An orthopaedic trolley as claimed in claim 3 wherein said adjustable mounting means comprises a box section slidably contained within a sleeve having a pin passing therethrough to locate said box section within the sleeve.

5. An orthopaedic trolley as claimed in claim 4 wherein said adjustable mounting means is of tubular construction within a tubular sleeve having a pin passing through the sleeve and the tube to locate said support structure in a particular position.

6. An orthopaedic trolley as claimed in claim 1, wherein said legs are interconnected only at their inner ends and the trolley is maneuverable by a patient user's ble foot limb.

7. An orthopaedic trolley as claimed in claim 1, wherein said patient knee and leg support means includes a non-flexible foam filled cushion support.

8. An orthopaedic trolley as claimed in claim 1, wherein said patient knee and leg support means includes a cradle which is attached to said support structure generally towards the end substatially at said principal weight bearing area.

* * * * *